US007060924B1

(12) United States Patent
Beene et al.

(10) Patent No.: US 7,060,924 B1
(45) Date of Patent: Jun. 13, 2006

(54) DUAL TACTILITY KEYPAD SWITCH

(75) Inventors: David Beene, Ramona, CA (US); John Philip Taylor, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 0 days.

(21) Appl. No.: 11/041,137

(22) Filed: Jan. 20, 2005

(51) Int. Cl.
*H01H 1/10* (2006.01)

(52) U.S. Cl. ..... 200/512; 200/314; 200/406

(58) Field of Classification Search ..... 200/406, 200/516–520, 341, 511–513
See application file for complete search history.

(56) References Cited

U.S. PATENT DOCUMENTS 4,700,377 A 10/1987 Yasuda et al.
4,933,522 A * 6/1990 Celander ..... 200/513
5,311,175 A 5/1994 Waldman
6,423,918 B1 * 7/2002 King et al. ..... 200/406
6,486,427 B1 * 11/2002 Pruvot ..... 200/406
6,563,068 B1 * 5/2003 Yamagata et al. ..... 200/406
6,573,467 B1 * 6/2003 Nakanishi et al. ..... 200/406
6,680,677 B1 1/2004 Tiphane
6,735,307 B1 5/2004 Völckers

* cited by examiner

*Primary Examiner*—Richard K. Lee

(57) ABSTRACT

A keypad assembly comprising a substrate, a membrane, and a logic component. The substrate has at least one set of electrical contact points that comprise a first, second, and a third conductive electric-contact area. The membrane comprises domed elements having a conductive elements fixedly attached thereto. Each conductive element is configured to interface with one or more of the electrical contact points with a soft press and a hard press. The logic component is in operative communication with the substrate and the membrane. The logic component is configured to distinguish between the soft press and the hard press.

20 Claims, 5 Drawing Sheets

Standard Or Heavy Pressure

No Pressure

Light Pressure

Standard Or Heavy Pressure

DUAL TACTILITY KEYPAD SWITCH

FIELD OF THE INVENTION

This invention relates to membrane keypad input devices often found on general consumer products. More particularly, the invention pertains to a new membrane button assembly that provides at least two logical functions according to the amount of pressure applied to the key.

BACKGROUND OF THE INVENTION

Membrane switches are economical to produce, and have become universally prevalent in keypads for consumer items such as cell phones, handheld game devices. Similar products are generally manufactured with membrane switches. Membrane switches can be formed and used as keypads or any other input device. In general, membrane switches are momentary-on contact switches in which at least one contact is on, or made of, a flexible substrate.

By way of example and not of limitation, the membrane switch comprises a flexible substrate layer having a contact that is shaped like a dome. When force is applied to the dome, the dome deforms and closes the switch. Thus, the membrane switch comprises springing means for each contact point on the keypad.

For a keypad in which the membrane switch is in a resting position, the conductive elements of the switch are out of contact. When the "dome" of the flexible substrate layer is pushed, the "dome" yields and the conductive elements of the dome touches another contact point and forms a detectable circuit. As soon as pressure is released from the dome, the membrane switch returns to its normal "dome" shape and this returns the switch to its normally open position.

Referring to FIG. 1, there is shown a block diagram of a printed circuit board (PCB) used in the cell phone industry. The illustrative PCB 100 has a 4×3 keypad matrix in which the first row corresponds to the 1, 2, and 3 numerical keys of a typical keypad, the second row corresponds to the 4, 5, and 6 keys, and so on. Each button locus on the PCB 100 has a corresponding set of concentric conductive circles. Outer circle 102 represents the outer-most portion of the key location that has conductive material on the PCB. Circle 104 marks the end of the conductive material deposited between circles 102 and 104. Circle 106 has as its interior a single conductive area.

If the conductive areas are blackened as in an actual PCB, two concentric circles, 108 and 110, are visible. For the illustrative membrane switch, a key press electrically connects these two conductive areas 108 and 110, enabling detection of the key press.

The prior art membrane switches provide limited tactile feedback. For example, the key press which connects the conductive areas for FIG. 1 is limited to having a single level of tactile feedback and a single logical on-off function. To help users differentiate which keys are being used, the existing art has relied on two solutions.

The first solution for providing tactile feedback is based on long-standing electric typewriter or adding machine conventions, in which certain keys have raised markings cast into the top of the keys. This raised markings allows an experienced touch-typist to know where his or her fingers are on the input device. This works for persons having good tactile feel that have memorized the keyboard layout. Additionally, the top of each key is typically large enough that a person's finger can not touch two at a time.

The second solution for providing tactile feedback is to use unusual physical key layouts, which are intended to be more user friendly. For example, in U.S. Pat. No. 6,766,023 which was issued to Kiernan, an example of a modified physical key layout with the intent of improving ergonomics is described. The modified physical key layout requires having a user learn the new keyboard layout.

SUMMARY

The dual tactility keypad switch enables a user to have two logical functions available for one or more keys on a keypad or key board. In the illustrative embodiment, the dual tactility keypad switch enables each key to have a "soft" press, which requires applying little pressure, and a "hard" press, which requires applying the usual pressure for a regular single function key. The keypad is constructed of a membrane over a substrate. The illustrative substrate has three contact points for each key. The overlaying membrane has a domed element for each key. Inside each dome element is a conductive element that is fixedly coupled to the concave side of the key dome.

The membrane is fixedly coupled to the substrate so that soft press puts the conductive element into contact with two of three contact points found under each dome element. Additional pressure, i.e. the hard press, forces the conductive insert into contact with at least one of the two previously engaged contact points plus the third contact point. A logic component distinguishes between a hard press and a soft press.

In an illustrative embodiment, the creation of the soft press key stroke enables users of electronic devices to obtain feedback about the key the user's finger is on, before having to enter the key into the device. After the user determines the user is on the desired key with the soft press, the user can then proceed to add pressure and make the hard press which enables the key to perform the desired function.

By way of example and not of limitation, the keypad of a cell phone can be adapted in a manner described above. By using the dual tactility keypad switch, the user can lightly run their fingers over the keyboard and watch the phone display or listen to the phone to determine which key the user's finger is on. The display tells the user which key would be input to the cell phone, if the key was pushed harder. By way of example and not of limitation, the key output will be displayed in a large font to effectuate quick and easy visual scans. Thus, users obtain feedback about a key they are about to press before actually committing to input the key.

This ability to obtain feedback will be particularly helpful to users who have mild to severe visual impairments, or, who have reduced finger dexterity or tactile feedback due to accidents, age, or disease. Additionally, this feedback can be used in environments in which users are preoccupied with other tasks, such as driving.

BRIEF DESCRIPTION OF THE DRAWINGS

The present dual tactility keypad switch will be more fully understood by reference to the following drawings which are for illustrative, not limiting, purposes.

DETAILED DESCRIPTION OF THE INVENTION

Persons of ordinary skill in the art will realize that the following description of the present invention is illustrative and not in any way limiting. Other embodiments of the invention will readily suggest themselves to such skilled persons having the benefit of this disclosure.

Referring more specifically to the drawings, for illustrative purposes the dual tactility keypad switch is illustrated in FIG. 2 through FIG. 5. It will be appreciated that the apparatus may vary as to configuration and as to details of the parts, and that the method may vary as to details, order of the actions, or other variations without departing from the inventive concepts disclosed herein.

The present dual tactility keypad switch provides a new apparatus and method for generating additional key inputs using a fixed number of keys, and in one embodiment improves user feedback when using keys on a cell phone, handheld game device, PDA, or similar electronic device. The description given below will primarily focus on one illustrative embodiment which is a cell phone. However, it will be clear that the new keypad of the present invention is usable in any consumer device where the user has to use keys as an input device.

Figure 1:
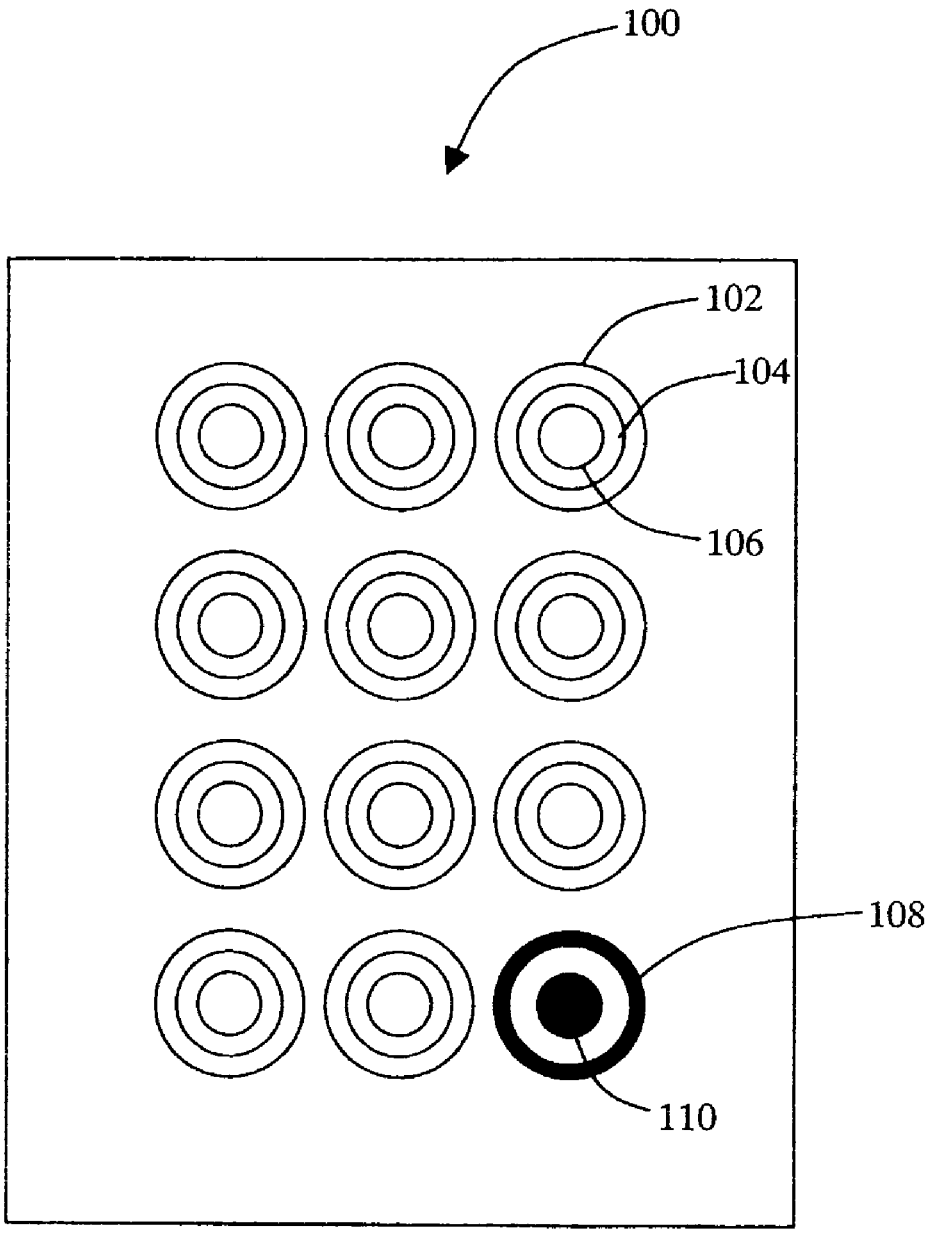
FIG. 1 (Prior Art)
FIG. 1 shows an illustrative diagram of a prior art printed circuit board (PCB).
Figure 2A:
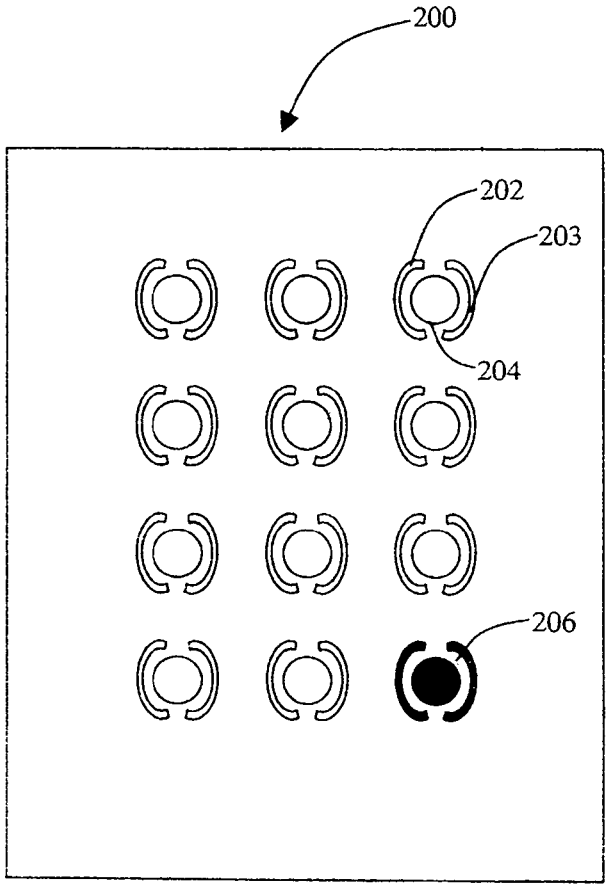
FIG. 2A shows an illustrative diagram of a substrate according to an embodiment of invention.

Referring to FIG. 2A there is shown an illustrative substrate for use with the dual tactility keypad switch. The substrate comprises one set of electrical contact points that includes, but is not limited to, at least three conductive electric-contact areas. The illustrative substrate is a printed circuit board (PCB) 200 having a generic 4×3 key matrix, with three electrically separated contact areas at each button locus. By way of example and not of limitation, an illustrative one key locus comprises a first electric-contact area 202 and a second electric-contact area 203, which form a half-circle surrounding a third circular electric-contact area 204. The first electric-contact area 202 and second electric-contact area 203 are both rounded conductive elements that are adjacent to one another as shown in FIG. 2A. The center conductive area 204 is circular and is surrounded by the first electric-contact area 202 and the second electric-contact area 203. Although shown for simplicity in circular form, it is clear the contact areas may vary in shape and relative placement while remaining within the scope of the claims. For an illustrative set of electrical contacts 206, the conductive areas are show in black.

Figure 2B:
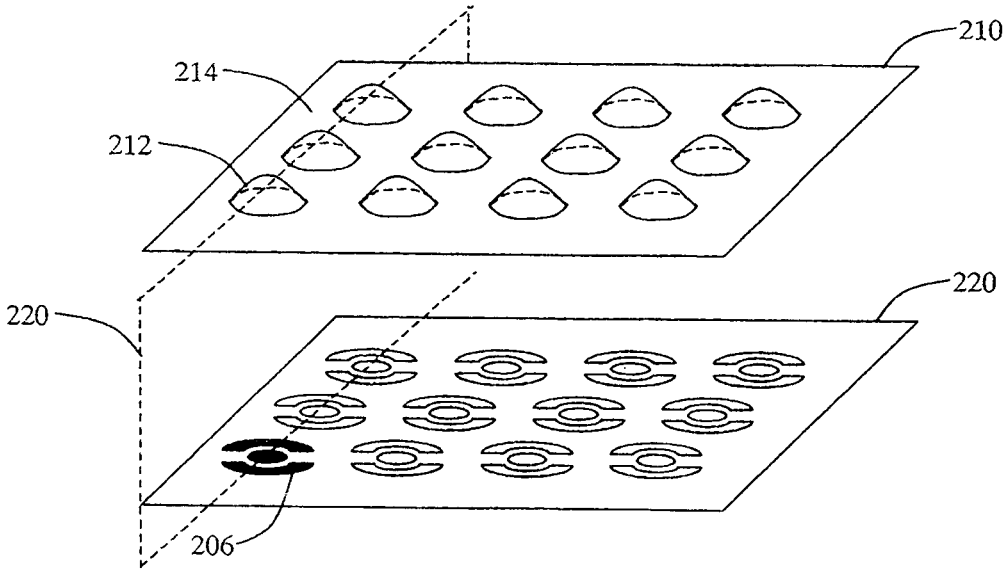
FIG. 2B shows an isometric view of an illustrative membrane disposed above the substrate according to an embodiment of invention.

Referring to FIG. 2B there is shown an isometric view of an illustrative membrane disposed above the substrate 200. Although the illustrative membrane 212 is displayed as being above the substrate 200, those skilled in the art shall appreciate that the membrane 212 is fixedly coupled to the substrate 200. The membrane 212 comprises a plurality of domed elements such as domed element 212 which is disposed above the set of electrical contacts 206. Each domed element comprises a convex surface, i.e. top of the membrane 210, and a concave surface, i.e. bottom the membrane 210. Each of the domed elements is circumscribed by a flat portion of the membrane 214.

When the membrane 210 is fixedly coupled to the substrate 200, the illustrative domed element 212 overlies the illustrative key locus 206. This represents a first state in which no action has been taken by the user.

The membrane 210 is typically cast as a single sheet for the entire keypad, with domed portions over each set of electrical contacts. A domed conductive element (not shown) is fixed coupled to the concave surface of each dome. By way of example and not of limitation, the conductive element is a stainless steel insert which is permanently affixed to the inside of each domed portion of the membrane. Membrane 210 is flexible at the portion between the outer edges of the conductive dome and where it is fixedly attached to the PCB. Varying membrane 210's inherent stiffness is one way in which the pressure required for the soft press can be varied.

Figure 3A:
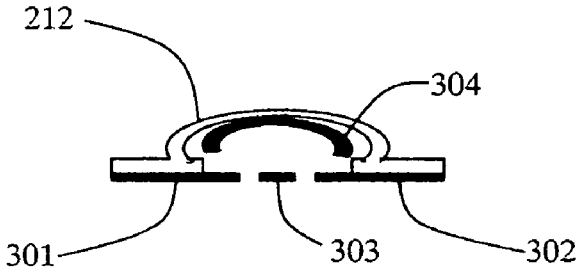
FIG. 3 shows a cross-sectional view of a single membrane button and substrate according to an embodiment of invention.

Referring to FIG. 3A there is shown a cross section of an illustrative button or key composed of the substrate 200 and membrane 210. This illustrative key corresponds to a cross-sectional view taken along dotted line 220 in FIG. 2B of the key defined by domed element 212 and the set of electrical contacts 206. The set of electrical contacts 206 comprises a plurality of conductive areas that correspond to a first conductive electric-contact area 301, a second electric-contact area 302, and a conductive electric-contact area 303 similar to the conductive areas described in FIG. 2B above. A domed conductive element 304 is fixedly coupled to the concave surface, i.e. bottom or inside of the dome element, of the domed element 212. By way of example and not of limitation, the conductive element 304 is a stainless steel insert which is permanently affixed to the inside of each domed element of the membrane.

FIG. 3A shows the button or key in its first state or "resting position", in which no pressure is being applied to the domed element 212. In this first state there is no connectivity or electrical contact any of the three conductive electric-contact areas and the conductive element 304.

Figure 3B:
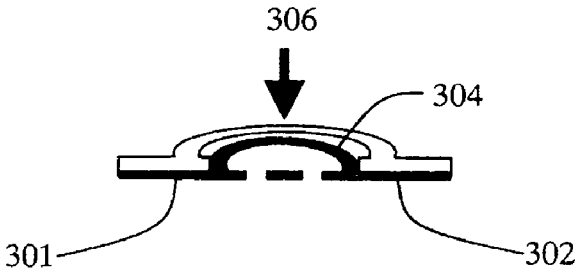

Referring to FIG. 3B there is shown a second state in which light pressure 306 is being applied to the domed element 212. The light pressure is also referred to as a "soft press." The soft press is typically performed with a fingertip or thumb. The soft press results in domed conductive element 304 being moved downwards until the conductive element 304 touches some portion of the first electric-contact area 301 and the second electric-contact area 302. In the illustrative embodiment, the domed conductive element 304 is depressed from a natural bias position to a first distorted position in which the conductive element 304 is in electrical contact with the first electric-contact area 301 and second electric-contact area 302, and not in contact with the third electric-contact area 303.

Figure 3C:
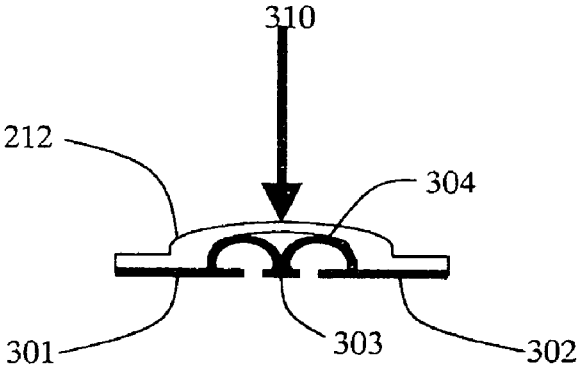

Referring to FIG. 3C, there is shown a third state in which standard or heavy pressure 310 is being applied to the domed element 212. This standard or heavy pressure 310 is also referred to as a "hard press." When a hard press 310 is applied to the domed element 212, the conductive element 304 collapses its center. As a result of conductive element 304 collapsing, the conductive element 304 is in electrical contact with the central circular third electric-contact area. Additionally, the conductive element 304 is in electrical contact with either the first electric-contact area 301, or the second electric-contact area 302, or both. Users shall appreciate that the additional pressure needed to push the center of domed element 304 into the third electric-contact area provides familiar tactile feedback to the user.

The key buttons of the dual tactility keypad switch provide for at least two tactilely distinct logical functions for each button. The first tactile logical function occurs when the key pad assembly transitions from a first state (see FIG. 3A) to a second state (see FIG. 3B). The first logical functions results from the soft press described above. In one embodiment, the first logical function results in a visual representation of the operation associated with the selected key. In another embodiment, the first logical function results in an auditory representation of the operation associated with the selected key. In yet another embodiment, a visual and auditory representation result from the soft press.

The second tactile logical function takes place when the second state (see FIG. 3B) transitions to the third state (see FIG. 3C). The second logical function results from the hard press described above. Alternatively, a user may go directly from the first state directly to the third state by applying only a hard press. The hard press is "hard" only relative to the soft press. In the illustrative embodiment, the hard press corresponds to the normal pressure required to use keys on the target device. By way of example and not of limitation, the hard press for a cell phone corresponds to what is presently the normal finger pressure required to use each key on the cell phone's keypad.

In operation, the triggering pressure required to use the soft press will be less than ½ the pressure required to use the hard press. However, it shall be appreciated by those skilled in the art having the benefit of this disclosure, that the actual triggering pressure of the soft press, although always less than the hard press, will be designed differently for each application to meet the needs of the target audience. In addition, as experience is gained with the use of the present invention, alternate user-friendly pressure ratios between the hard press and the soft press may become evident.

In an illustrative embodiment, the soft press will be used to provide instant, clear feedback to the user of the input device. Upon resting their finger on a key, the user will trigger the soft press state and the device will display the key being pressed. The displayed key will not be entered into the device in the usual manner, and upon the moving of the user's finger from the present key, the display no longer shows the just-released key. The user does not have to "delete" or otherwise do anything because the key is not entered. This allows a user to quickly run their finger across a keypad and, looking at the display, to quickly find the key they are looking for.

Another illustrative embodiment provides a key display associated with the soft press shown in unusually large format, preferably temporarily overwriting other parts of the display, or temporarily making use of the entire display. This type of display allows quick visual scanning and quick visual confirmation of keys being touched.

Yet another illustrative embodiment provides a soft press input that will also trigger an auditory recitation of the key being touched. This may be done in conjunction with, or instead of, the visual display. As with the visual display, as soon as the user moves their finger the auditory recitation will stop.

When, using the soft press inputs, a user identifies the key they want to input to the device, they simply press harder which triggers the hard press key function. In an illustrative hard press embodiment, the hard press simply carries out the function that is ordinarily associated with a "normal" press of a key on the keypad. Thus, for users familiar with the device, a normal key press (which corresponds to the hard key press of the present invention) produces the expected response. This allows a user to make use of the soft press or to functionally by-pass the soft press by simply using a hard press.

It shall be appreciated by those skilled in the art, that each of embodiments described above may be combined with one another. The precise combination for each of the embodiments will depend on the particular application.

Figure 4:
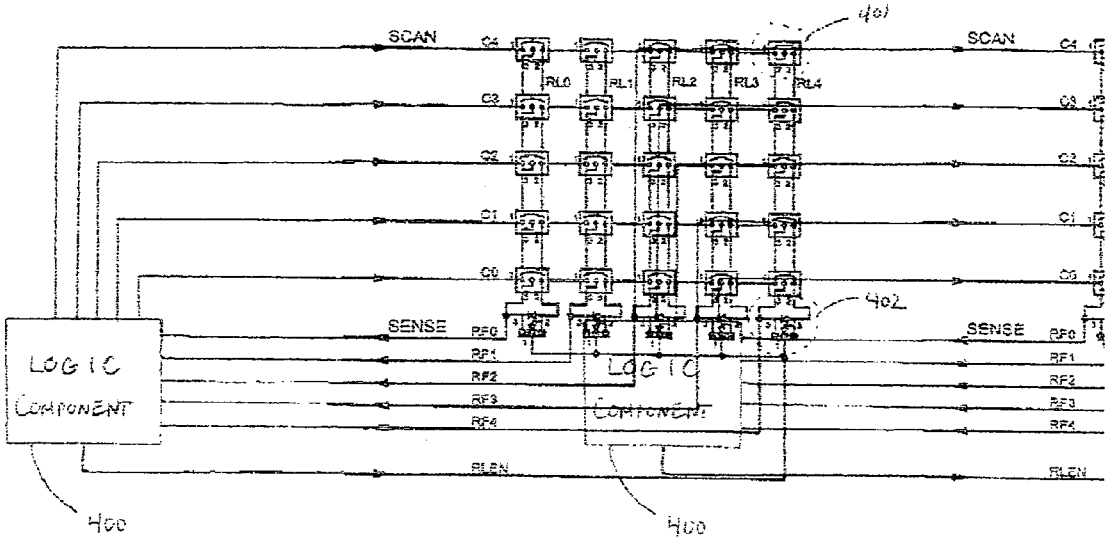
FIG. 4 shows a logic component and a portion of a circuit schematic for the keypad according to an embodiment of invention.

Referring to FIG. 4, there is shown a schematic with a logic component and circuitry usable with the dual tactility keypad switch. The logic component 400 distinguishes between a hard press and the soft press, as well as recognized that no keys have been pressed. The illustrative circuitry that is shown has been tested and is currently the preferred embodiment. However, those with skill in this art and having the benefit of the present disclosure will readily see there are numerous alternative circuits using different subcomponents also usable with the present invention. All such enabling circuits are within the inventive scope of the present invention.

FIG. 4 shows a logic component 400 (typically a CPU, but may be other logic such as FPLAs, etc.) that interfaces with circuitry usable with the dual tactility keypad switch. The logic component 400 is used to scan the scan lines (generate the signals on the lines), interpret interrupts from the sense lines, set the MOSFETs on and off, and perform functions as a result of the inputs gathered from the keypad. The logic component 400 interfacing to the schematic shown in FIG. 4 will be very specific to the device in which the keypad is used. A person having skill in this art and with the benefit of the present disclosure can readily interface the schematic in FIG. 4 with a specific device's CPU or other logic. For example, if the keypad of the present invention is used in a cell phone having a Qualcomm® chipset, then the scan lines and sense lines would simply be run to designated pins on the CPU, and a gpio line from the same CPU would be used to drive the MOSFETs. Similar considerations would be made for each application.

Each button 401 has three contacts, shown as 1, 2, and 3. Contacts 1 and 2 correspond to conductive areas 301, 302, and 303 in FIG. 3, respectively. Contact 3 corresponds to center conductive area 303. A soft press makes electrical contact between 1 and 2, and a hard press makes contact between all three. MOSFETs 402 are added to enable soft and hard presses to be distinguished. If one of the sense lines then goes low, the key being pressed is identified and it is a hard press. If no sense line goes low, the MOSFETs are enabled. If one of the sense lines then goes low, the key being pressed is identified and it is a soft press.

This embodiment has the additional advantage of being inexpensive to implement for the additional functionality provided. The additional cost over a standard keypad has been estimated to be well under $0.50 at current material and manufacturing costs. This is more than an order of magnitude less expensive than using a touch screen, for example. Aggressive costing is a very important consideration for inexpensive consumer items such as cell phones, lower-end handheld game and entertainment devices, and the like.

Figure 5:
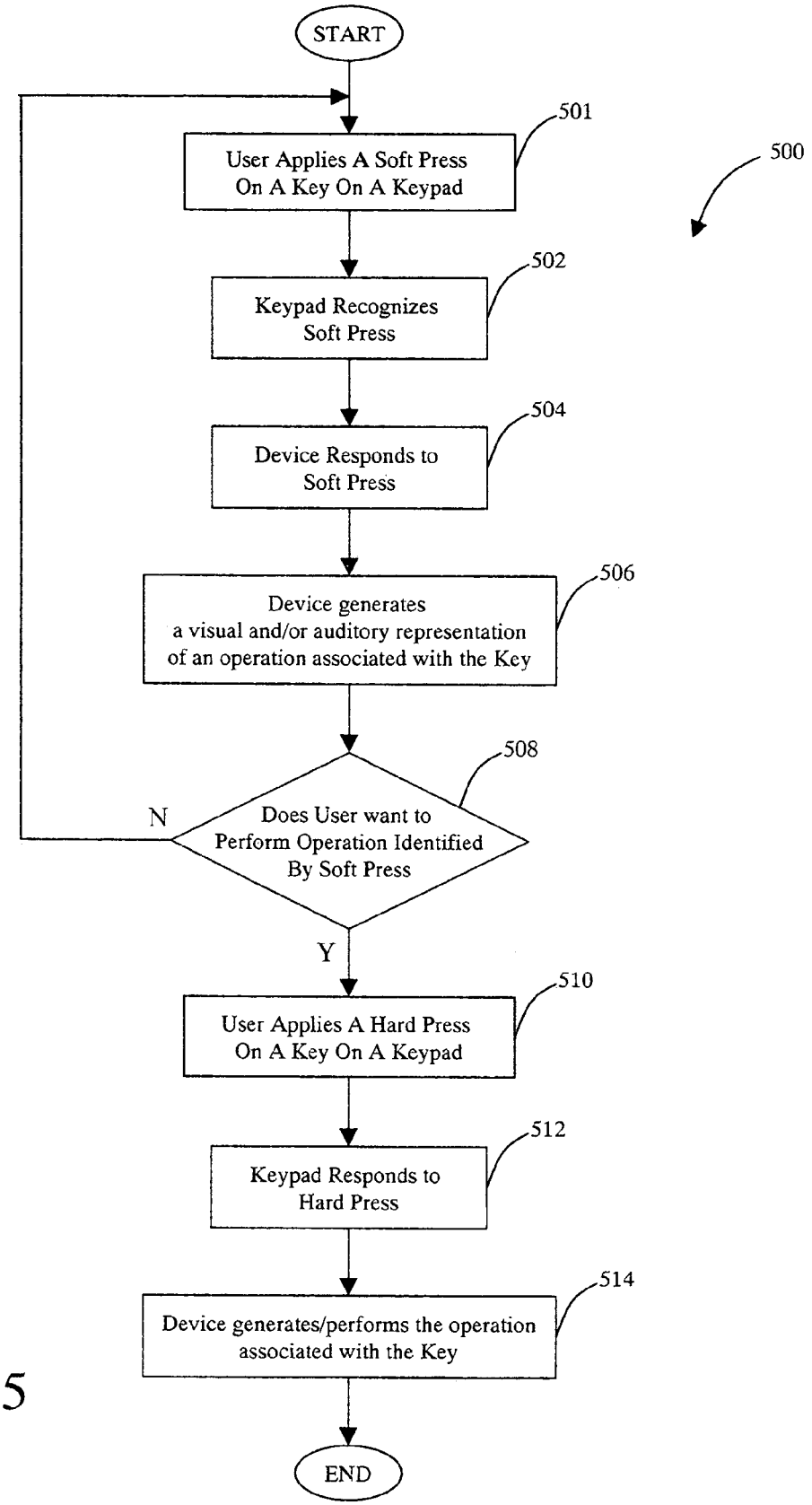
FIG. 5 shows a flowchart illustrating the use of the keypad according to an embodiment of invention.

Referring to FIG. 5 there is shown is a flowchart 500 illustrating the use of a keypad having the dual tactility keypad switch. In the illustrative embodiment, the method is initiated at block 501 when the user decides to apply a soft press to the key defined by domed element 212 and key locus 206.

At block 502, the keypad pad recognizes the soft press. The soft press results in a first logical function which is caused by the transition from the first state to the second state. The first state occurs when the conductive element 304 is not in electrical contact with the first electric contact area 301, the second electric contact area 302, and the third electric contact area 303. The second state occurs when the conductive element 304 is in electrical contact with the first electric contact area 301 and the second electric contact area 302, but not in contact with the third electric contact area 303. The logic component 401 distinguishes between states.

At block 504, an illustrative devices such as a cell phone, PDA or computer, recognizes the soft press and proceeds to respond to the soft press action. In the illustrative embodiment, the device generates a visual and/or auditory representation of the operation that is associated with the soft press key as described in block 506. For example, for a soft press of a cell phone keypad, the cell phone is programmed to display or "preview" the number corresponding to the key being lightly pressed. It may be displayed on the phone's visual display in an extra large, distinctive font. Other data in the viewing area of the display, which may or may not be the entire physical display, is temporarily hidden. In another illustrative example, the numerical value of the key will be spoken through the phone's speaker at the same time.

More generally, the device responds in any manner that is programmed into it, corresponding to the soft press for a specific key. Note that the soft press logical function depends on the goals of the product designer. For example, if the product were a web-enabled handheld device and the key lightly pressed was a "scroll" key, then the soft press could be programmed to do a "fast continual" scroll and a hard press a "page-by-page" scroll. If it were a handheld game device, then the soft press is associated with various "play action" keys that correspond to the figures on the screen making verbal statements about what to do next, or user options. The hard press of the same key could then cause the action just described. These two examples merely tap the surface of what is possible using the extra functionality that could be implemented using the keypad of the present invention.

At decision diamond 508, the user determines whether to perform the operation identified by the soft press. If the visual and/or auditory representation identifies that the wrong key had been pressed by user, the user then returns for block 501 to search for the desired key. Thus, if an illustrative key is previewed, the user is permitted to select another key that performs the desired operation. If the visual and/or auditory representation identifies the desired key has been pressed, then the method proceeds to block 510.

At block 510, the user then applies a hard press to the desired key. The keypad recognizes the hard press and responds to the hard press by generating a second logical function which is caused by a transition from the second state to the third state, or from the first state to the third state. The third state occurs when the conductive element 304 is electrical contact with the third electric-contact area 303 and either the first electric-contact are 301, the second electric-contact area 302, or both.

At block 514, the device proceeds to perform the desired operation. For the illustrative cell phone embodiment, this may simply mean entering the number associated with the key that was subjected to the hard press.

It shall be appreciated by those of ordinary skill in the art having the benefit of this disclosure that the goal in these embodiment is to make user interactions with individual keys on a keypad significantly easier than the prior art. This is accomplished by having the soft press, which provides feedback about each key before actually inputting the key. This is expected to be helpful to numerous individuals, including persons having some visual impairment, persons whose fingers have lost some dexterity or tactile awareness through accident, sickness, or age, or, on smaller phones, persons with fingers that visually cover more than one key, or persons who are driving. In all these cases the ability to find out what key a finger is on, before entering the key, provides much needed feedback to the user.

It is to be understood that the foregoing is a detailed description of illustrative embodiments. The scope of the claims is not limited to these specific embodiments. Various elements, details, execution of any methods, and uses can differ than those just described, or be expanded on or implemented using technologies not yet commercially viable, and yet still be within the inventive concepts of the present disclosure. The scope of the invention is determined by the following claims and their legal equivalents.

What is claimed is:

1. A keypad assembly, comprising:

a substrate having at least one set of electrical contact points comprising a first conductive electric-contact area, a second conductive electric-contact area, and a third conductive electric-contact area;

a membrane comprising at least one domed element having a conductive element fixedly attached to said membrane, said conductive element configured to interface with one or more of said set of electrical contact points with a soft press comprising a first conductive connection between at least one of said electrical contact points, and a hard press comprising a second conductive connection between at least one of said electrical contact points; and a logic component in operative communication with said substrate and said membrane, said logic component configured to distinguish between said soft press and said hard press.

2. The keypad assembly of claim 1 wherein said first electric-contact area and said second electric-contact area are both rounded conductive elements that are adjacent to one another.

3. The keypad assembly of claim 2 wherein said third contact area is a circular conductive element that is surrounded by said first electric-contact area and said second electric-contact area.

4. The keypad assembly of claim 1 wherein said soft press enables a first logical function.

5. The keypad assembly of claim 4 wherein said first logical function enables a visual representation of said operation associated with said at least one key.

6. The keypad assembly of claim 4 wherein said first logical function enables an auditory representation of said operation associated with said at least one key.

7. The keypad assembly of claim 4 wherein said hard press enables a second logical function.

8. The keypad assembly of claim 7 wherein said second logical function enables said operation associated with said at least one key.

9. The keypad of claim 7 wherein said second logical function enables an operation associated with said at least one key.

10. A method of assembling a keypad having at least one key configured to perform at least two functions, the method comprising:

providing a substrate having at least one set of electrical contact points comprising a first conductive electric-contact area, a second conductive electric-contact area, and a third conductive electric-contact area;

providing a membrane comprising at least one domed element having a conductive element fixedly attached to said membrane, said conductive element configured to interface with one or more of said set of electrical contact points;

providing a resting position wherein said domed conductive element and said electrical contact points are electrically disconnected;

generating a first logic function after a soft press, said soft press resulting from said conductive element being in electrical contact with at least one of said electrical contact points;

generating a second logic function after a hard press, said hard press comprising said conductive element being in electrical contact with at least one of said electrical contact points, said hard press established by increased pressure on said membrane relative to said soft press.

11. The method of claim 9 wherein said first logical function generates a visual representation of said operation associated with said at least one key.

12. The method of claim 11 wherein said first logical function provides a preview of the operation associated with said at least one key.

13. The method of claim 12 wherein said preview is configured to permit a user to select another key that performs another operation.

14. The method of claim 12 wherein said second logical function generates said operation associated with said at least one key.

15. The method of claim 11 wherein said first electric-contact area and said second electric-contact area are both rounded conductive elements that are adjacent to one another and configured to enable said first logical function.

16. The keypad assembly of claim 15 wherein said third contact area is a circular conductive element that is surrounded by said first electric-contact area and said second electric-contact area and configured to enable said second logical function.

17. The method of claim 9 wherein said first logical function generates an auditory representation of said operation associated with said at least one key.

18. A keypad assembly, comprising:

a substrate having at least one set of electrical contact points comprising a first conductive electric-contact area, a second conductive electric-contact area, and a third conductive electric-contact area, means for flexibly engaging said electrical contact points having a conductive element configured to flexibly engage said electrical contact points in response to varying pressure, said means for flexibly engaging said electrical contact points comprising at least one domed element configured to interface with said first conductive electric-contact area, said second conductive electric-contact area, and said third conductive electric-contact area; and a means for enabling said keypad to identify a first logical function after a soft press;

a means for enabling said keypad to identify a second logical function after a hard press; and a resting position wherein said conductive element and said electrical contact points are electrically disconnected.

19. The keypad of claim 18 wherein said first logical function enables a visual representation of said operation associated with said at least one key.

20. The keypad of claim 18 wherein said first logical function enables an auditory representation of said operation associated with said at least one key.

* * * * *